US005905436A

United States Patent [19]

Dwight et al.

[11] Patent Number: 5,905,436

[45] Date of Patent: May 18, 1999

[54] SITUATION-BASED MONITORING SYSTEM

[75] Inventors: Leslie Dwight, South Deerfield, Mass.; Ronald L. Briggs, Concord, Vt.

[73] Assignee: Gerontological Solutions, Inc., South Deerfield, Mass.

[21] Appl. No.: 08/956,351

[22] Filed: Oct. 23, 1997

Related U.S. Application Data

[ 60] Provisional application No. 08/029,106, Oct. 24, 1996.

[51] Int. Cl.[6] ..... G08B 23/00

[52] U.S. Cl. ..... 340/573.1; 340/529; 340/522; 600/595; 395/838

[58] Field of Search ..... 340/573.1, 529, 340/540, 522, 541; 600/595; 395/838

[56] References Cited

U.S. PATENT DOCUMENTS

| | | | |
|---|---|---|---|
| 4,494,656 | 1/1985 | Shay et al. | 209/524 |
| 4,829,285 | 5/1989 | Brand et al. | 340/573 |
| 4,858,622 | 8/1989 | Osterweil | 600/595 |
| 5,023,593 | 6/1991 | Brox | 340/522 |
| 5,534,851 | 7/1996 | Russek | 340/573 |
| 5,670,943 | 9/1997 | DiPoala et al. | 340/567 |
| 5,692,215 | 11/1997 | Kutzik et al. | 395/838 |

*Primary Examiner*—Benjamin C. Lee
*Attorney, Agent, or Firm*—Richard H. Kosakowski, Esq.; Donald S. Holland, Esq.; Holland & Bonzangni, P.C.

[57] ABSTRACT

A situation-based monitoring system monitors various activities of persons in rooms of a home or residential care facility, determines when the person is in distress and communicates that fact to appropriate personnel. The system includes a programmable processor connected with sensors in the monitored area. The sensors detect various physical parameters associated with the monitored persons, such as motion or the identity of the persons themselves. From the sensed conditions, the processor determines when a distress situation or condition exists (e.g., a person has fallen) and communicates information about the distress condition to a notification device. Various situations may be configured differently for different people. The communication can either be an alarm indicating a condition requiring immediate attention, or may be information-only. The notification can be transmitted to a notification device, such as a computer or digital dialer via a modem or direct data exchange, which is accessed by emergency response personnel.

17 Claims, 4 Drawing Sheets

PLC (FIG.3)
DIGITAL DIALER
172
PHONE
184

PLC (FIG.3)
COMPUTER
176
UPS
188
VIDEO DISPLAY
192
PRINTER
196

PLC (FIG.3)
COMPUTER
176
UPS
188
PAGING XMITTER
200
PRINTER
196
UPS
208
PAGING RECEIVER
204

PLC (FIG.3)
MODEM
180
COMPUTER
176

100
UPPER SENSOR #1
120
LOWER SENSOR #1
124
UPPER SENSOR #2
128
LOWER SENSOR #2
132
OTHER SENSORS (BED, CHAIR, etc.)
152
DOOR SENSOR
136
NOTIFICATION DEVICE (FIG. 4)
168
PLC
148
CPU
156
MODEM
164
UPS
160

SITUATION-BASED MONITORING SYSTEM

RELATED APPLICATION

This application is based in part on U.S. Provisional patent application Ser. No. 60/029,106, filed Oct. 24, 1996.

BACKGROUND OF THE INVENTION

This invention generally relates to a system for monitoring the activities of a person within a defined area, and more particularly to such a monitoring system which senses when a person is in distress and needs assistance and the system then notifies appropriate personnel, wherein the person in distress is not required to take any action to indicate the distress situation to the monitoring system.

The consequences of falling have a significant impact on the quality of life enjoyed by older persons. According to Dr. Michael L. Freedman, Director of Geriatrics at New York University Medical Center, one of every three persons 65 and older suffers a fall each year. As of 1996, two of every five admissions to nursing homes are the result of falls. Falls are now the sixth leading cause of death for persons over 70.

Although the consequences of falling can be significant, many older adults are reluctant to report falls for various reasons. For example, in residential care facilities, the person may fear being transferred away from friends and social life to a more managed environment. Sometimes falls go unreported because persons with cognitive dysfunction are unable to communicate coherently to family, friends or care givers. Falls may also go unreported by staff for fear of administrative issues or reprisals directed at them or the residents.

For many years and through many permutations of technology, people have wrestled with the problems and solutions involving an increasingly older elderly population. According to a 1996 report from the U.S. Department of Health and Human Services, the group of persons 85 and over is projected to be the fastest growing segment of the elderly population. It is expected that by the year 1999, the number of persons 65 and older will be over 35 million. Of those, over 4 million will be 85 and older.

As direct customers (i.e., persons living in their homes), elderly persons have been intimidated by the sophistication and cost of the devices available to assist them in managing their homes and achieving and maintaining independent lifestyles. As indirect customers (i.e., persons living in residential care facilities), their level of exposure to various technologies to better assist them has been dependent on the administrators' comfort with such technologies and the financial costs. Historically, residential care facilities have tended to shy away from using such monitoring technologies. Only recently has there been some increased utilization of modern technology in various aspects of such facilities, including resident emergency recognition and response.

One of the first areas of general acceptance and usage of technology for both homes and residential care facilities is that of personal emergency response. In the past, this was an area where little or no technology was utilized. Monitoring devices that did exist were limited in coverage area to a single room of a home or a resident's living area. Newer products have expanded their coverage area to encompass an entire home or a facility's perimeter through use of transmitters worn or easily accessed by the person. These transmitters often take the form of bulky pendants, wrist watches or pull cords. Each product requires the person to have quick and ready access to the transmitter and be able to activate the transmitter to initiate the call for help, even if the person has fallen and is immobile.

These requirements have proven to be an impediment to customers. Many people feel the transmitters are a badge that declares them to be less than capable adults. Most find the instruments unattractive. As a result, transmitters are often left in pockets or drawers and pull cords are tucked behind pictures, rendering them unreachable and of little or no assistance in times of distress.

Prior art monitoring systems can be generally grouped into two types: active and passive. To generate an alarm condition in an active monitoring system, some affirmative act by the person being monitored is required to indicate the person is in distress and needs assistance. The required act may comprise clapping, pushing a button, calling for help, or otherwise activating a transmitter.

On the other hand, passive monitoring systems may rely on the failure of the person to perform an act within a prescribed period of time or at a certain time of day; for example, the person does not use the phone or toilet for 24 hours, does not get out of bed by a certain time of day, or does not take medication at prescribed time intervals or at particular times of day. However, these systems are often complex to program, implement and utilize. As a result, they have achieved little or no commercial success. An example of such a passive system is found in U.S. Pat. No. 4,303,801.

Generally, these passive monitoring systems evaluate the activities of a person and generate an alarm if warranted. Based upon sensors, clocks and timers, these systems monitor a person's activities and trigger an alarm when the timer or clock indicates the monitored device was unused beyond its programmed time limit or was unused at a certain time of day. The system described in U.S. Pat. No. 4,303,801 monitors a plethora of devices, as well as the bathroom. However, its reliance on the resident to initiate an emergency process through inactivity can be a drawback, especially in facilities that deal with dementia patients.

People with dementia generally are not monitored with either active or passive monitoring systems because these people cannot consistently distinguish and recognize times of appropriate usage of certain items. As a result, residential care facilities are forced to rely on staff personnel to patrol resident rooms, bathrooms and common areas. This is both expensive and intrusive.

The percentage of the population who suffer from Alzheimer's disease is growing with the increasing number of persons over 85. Alzheimer's is one form of senile dementia. The American Medical Association reports that nearly one in two people over 85 suffers from some stage of Alzheimer's. Since the disease attacks the mind rather than the body, it often lasts for a long time. On average, those afflicted with Alzheimer's live eight more years after diagnosis, often needing round-the-clock care. To date, there is no cure in sight.

The usage of monitoring systems is not limited to the elderly. Younger persons may either be chronically or occasionally in need of monitoring. For example, hospice patients, patients newly released from the hospital, individuals with disabilities living independently, persons with permanent disabilities living at home, and others can all benefit from nonintrusive, situation-based monitoring systems.

Accordingly, it is a primary object of the present invention to provide a situation-based monitoring system that monitors the activities of a person within an area or location and automatically notifies appropriate parties when an actual or potential emergency situation occurs involving the monitored person.

A general object of the present invention is to provide a situation-based monitoring system that allows a person to live independently and safely in a home or residential care setting.

Another object of the present invention is to provide a situation-based monitoring system that does not require either initiation or inactivity by persons being monitored to indicate a distress situation to appropriate personnel.

It is a further object of the present invention to provide a situation-based monitoring system such that anyone who falls down within a predetermined area creates a distress condition recognized by the system as one requiring an alarm.

Yet another object of the present invention is to provide a situation-based monitoring system that recognizes a various number of actual or potential situations involving persons requiring assistance.

Still another object of the present invention is to provide a situation-based monitoring system that evaluates a location for the existence of various conditions of distress and generates an alarm, whether or not a person within that location (and responsible for creating that situation) is able to indicate the distress situation to the system.

It is another object of the present invention to provide a situation-based monitoring system that monitors the activities of a person in a non-intrusive manner.

Another object of the present invention is to provide a situation-based monitoring system that can configure situations differently for different persons.

The above and other objects and advantages of this invention will become more readily apparent when the following description is read in conjunction with the accompanying drawings.

SUMMARY OF THE INVENTION

To overcome the deficiencies of the prior art and to achieve the objects listed above, the Applicants have invented a situation-based monitoring system that monitors various activities or "situations" of one or more persons within a location, such as a living area (e.g., one or more rooms of a home or residential care facility), and determines when the monitored person is in distress and communicates that fact to appropriate personnel.

In general, the monitoring system of the present invention comprises a software-programmable signal processor connected with a plurality of sensors strategically located within the monitored living area. The sensors detect various physical parameters associated with persons in the monitored area, such as motion. The sensors may also be of an enhanced type that can recognize or identify certain individuals. From the sensed conditions, the signal processor determines when a distress condition or situation exists in the living area involving persons in that area. If the distress condition warrants notification to appropriate personnel, the system communicates information about the distress condition to an external notification device. The contents of the distress notification message can either be an alarm indicating a distress condition requiring immediate attention, or may be information-only. One such distress condition recognized by the monitoring system of the present invention is that of a person falling down within the area.

The notification can be transmitted to a notification device such as a computer via a modem, a direct data exchange ("DDE"), or by some other communication means or method. Alternatively, the notification can be transmitted to a digital dialer or other type of notification device located anywhere.

The communicated notification message may contain information about the type of distress situation (e.g., a fall) and its location (e.g., a bedroom). Since a variety of situations involving the monitored person may trigger a communication to the notification device, the situation type is preferably included within the notification message. Situations may also be specifically configured to different individuals. For example, a room occupied situation may be triggered after an elapsed time of 15 minutes for one individual and 30 minutes for another.

In a preferred exemplary embodiment, motion sensors are provided in various corners or locations of a room. Pairs of motion sensors may be located in the room such that one sensor in a pair monitors an upper vertical area or zone of the room while a second sensor in that pair monitors a lower vertical area of the room. Other types of sensors may be utilized as well. The sensors communicate sensed movement and other physical parameters in the sensing area to a programmable logic controller ("PLC"). When the PLC determines, from the sensed data, that a "situation" has arisen involving the monitored person (e.g., by way of motion in the lower zone and not in the upper zone), the PLC communicates the appropriate situation message to the notification device. The message may contain information describing the type of distress situation, time of occurrence, location, and the identification of the device sending the message.

When the notification device is a digital dialer, the PLC will generally only communicate alarm conditions thereto. No information-only conditions will be transmitted to the digital dialer. When the digital dialer is notified, it instigates a call to the first phone number in its hunt group list. A standard hunt procedure used by these devices will be in effect to connect with the first available person on the list. The persons on the list may be family members, friends, care givers, emergency response personnel or residential care facility personnel, arranged in any desired order on the hunt list. The dialer will not cease communication attempts with these persons until a connection has been completed. When the line is answered, a pre-recorded message will be played indicating the alarm and its location. Another feature of the system is the utilization of a speaker phone to enable a conversation between the person in distress and the receiver of the call.

In an institutional embodiment of the monitoring system of the present invention, a preferred notification device may be a computer. The computer may manage multiple monitored areas and support a plurality of simultaneously-occurring alarms. The computer may also store sensor data, situation location and resident information. A computer may also be used as the notification device in a home embodiment of the present invention.

When the notification device is a computer, connected to the PLC through either a modem or a DDE, the alarm is generally displayed at the computer terminal. The alarm may be both audio and visual. The audio component may be a repetition of the appropriate alarm phrase and its location. The visual component may be a screen display of alarm location and resident information. The information may also be printed on paper. To silence the alarm, the operator must, for example, enter his/her name and information regarding the resolution of the alarm condition. The computer may output an additional notification message via a paging transmitter to a remote receiver carried by security personnel.

If an information-only condition is transmitted by the PLC to the computer, the information is evaluated and captured into the appropriate database or computer memory storage. Information-only messages are not alarms, but indicate that a monitored event has occurred. These messages generally may contain a type descriptor, time and location of occurrence. Various types of information are supported, such as a person fell down but got up by themselves, a person got out of bed, or a person is in the monitored area.

Preferably, all communications to the computer are logged or stored on disk memory by the computer for later review. This allows someone to review monitored situation occurrences from different perspectives, such as by location, by resident or in a time sequence. The computer also offers an option to log messages to the printer as well as disk storage.

BRIEF DESCRIPTION OF THE DRAWINGS

FIG. 4, comprising FIGS. 4(*a*)–(*d*), are block diagrams illustrating various embodiments of notification devices that are part of the monitoring system of FIG. 1;

DETAILED DESCRIPTION OF THE PREFERRED EMBODIMENTS

Figure 1:
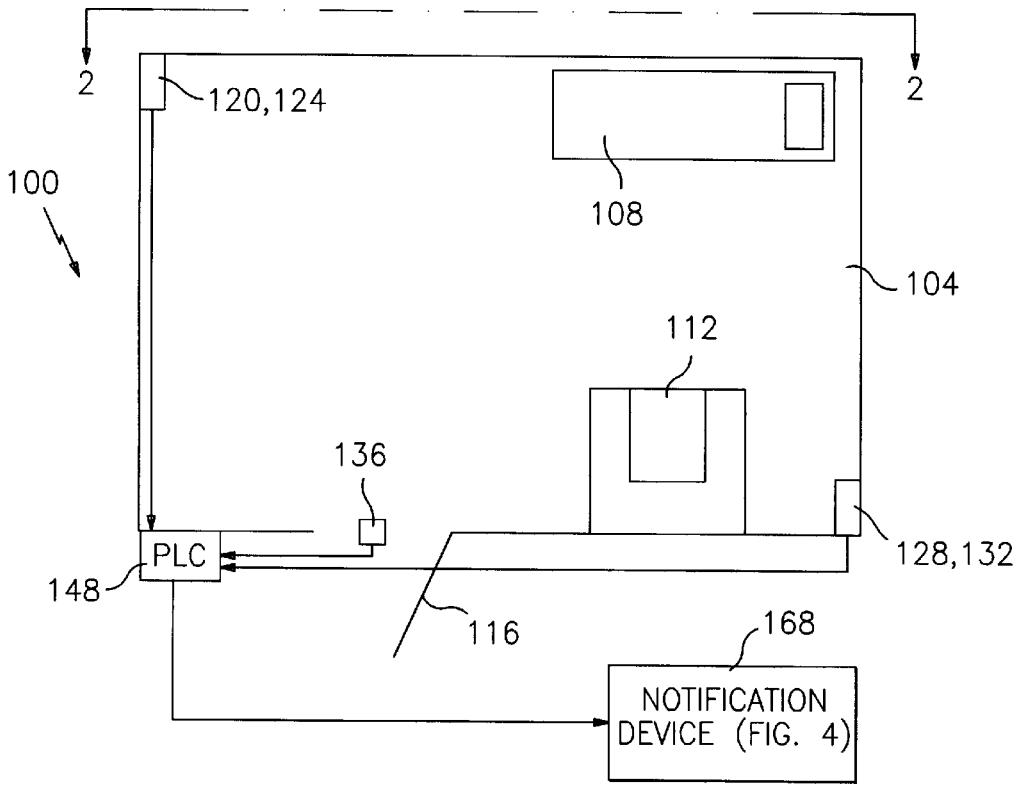
FIG. 1 is a top view of a room having the sensors and PLC of the monitoring system of the present invention implemented therein.

Referring to FIG. 1, there illustrated is a preferred, exemplary embodiment of the situation-based monitoring system 100 of the present invention. The system 100 is shown implemented in a bedroom 104 of a home or residential care facility. A typical room 104 includes a bed 108, a chair 112 and a door 116, with other objects normally found in a bedroom omitted for clarity. Motion sensors 120–132 are strategically distributed within the room 104 to sense motion in all areas of the room in which a person may fall and be injured. A door position sensor is also included.

Figure 2:
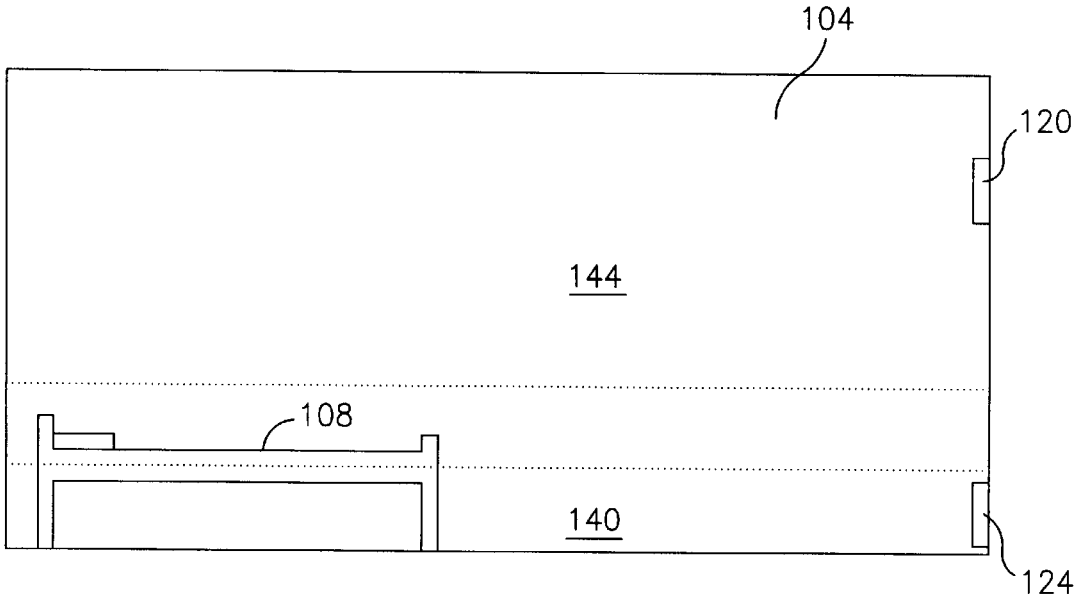
FIG. 2 is a vertical side view of the monitored room of FIG. 1, taken along the lines 2—2 of FIG. 1, showing a pair of sensors positioned vertically within the room.

The embodiment of FIG. 1 includes three different sensor groups. Sensor group one is comprised of a pair of commercially-available Sentrol brand Model 6353-W passive infrared motion sensors 120,124 mounted in one comer of the room 104. Referring also to FIG. 2, the group one sensors comprise an upper zone sensor 120 and a lower zone sensor 124. Each sensor has a 90 degree view of the room 104 from its position in the corner of the room. The lower zone sensor 124 responds to activity which occurs from a height of 16 inches down to the floor, thereby defining the lower zone 140. The upper zone sensor 120 monitors the room from a height of 7 feet 6 inches beginning at 31 inches above the floor and continuing upward to the ceiling, thereby defining the upper zone 144. FIG. 2 illustrates the zone coverage of the sensors in relation to the room 104 and the bed 108.

Sensor group two 128,132 is located across the room diagonally from sensor group one 120,124. That location of sensor group two is chosen to specifically cover any area of view of sensor group one obstructed by the chair 112. If desired, sensor group two may comprise solely the lower zone sensor 132, since the entire upper zone 144 of the room is completely covered by the upper sensor 120 of group one. However, for purposes of consistency and clarity, sensor group two is also represented as a pair of upper and lower zone motion sensors 128,132. Sensor group two may also comprise a pair of corner mounted Sentrol brand Model 6353-W passive infrared sensors covering upper and lower zones at a 90 degree angle of view.

The third sensor group is a single sensor which, in FIG. 1, is a Sentrol brand Model 6084-N Ceiling/Wall Mount Bracket holding a Sentrol 6155/6157 passive infrared motion detector 136 mounted above the doorway. In an institutional embodiment, this door sensor allows the resident to have an open door while providing enough data to a PLC 148 to enable it to determine room occupancy. In a home embodiment, a simple door contact can usually provide the same information regarding the open/closed position of the door.

Additional, optional sensors 152 (FIG. 3) may be utilized in conjunction with the bed 108 and/or chair 112. These sensors 152 provide an increased level of redundancy or accuracy in detecting the presence of a person within a room 104. Further, instead of or in addition to the motion sensors 120–132 described above, commercially-available enhanced sensors, which can recognize or positively identify a person (e.g., through use of the electromagnetic radiation pattern emitted by the person), may be employed.

Figures 3, 4A, 4B, 4C, 4D:
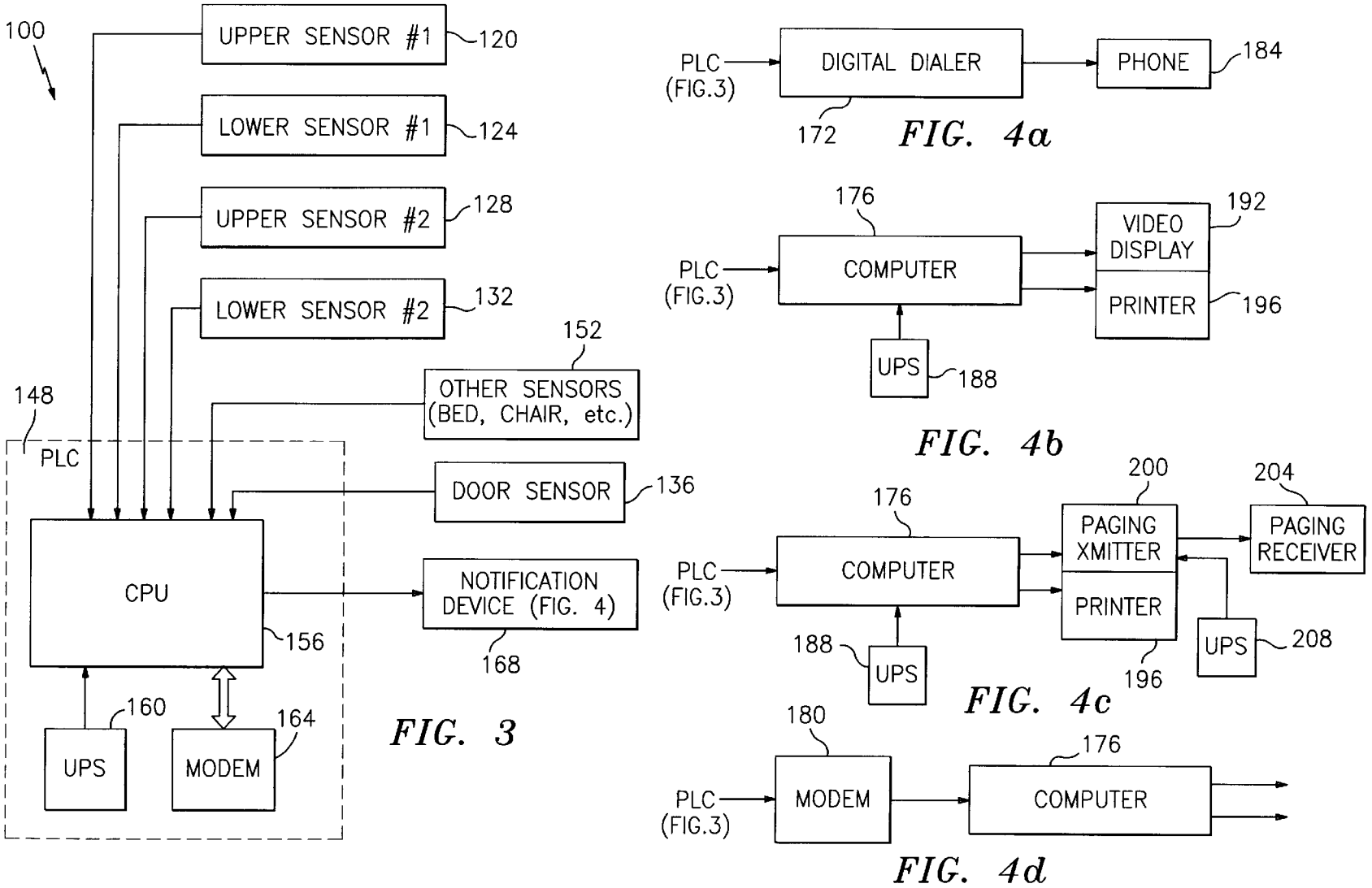
FIG. 3 is a detailed block diagram of the monitoring system of FIG. 1.

FIG. 3 illustrates, in more detailed block diagram form, the PLC 148 and the electrical connection of the various sensors of FIGS. 1 and 2 to a Central Processing Unit ("CPU")156 of the PLC 148. Depending upon the number of sensors utilized and the notification method employed, the PLC CPU 156 may be either a Model D4-440 or a Model D2-240, both commercially-available from Koyo. However, these devices are purely exemplary; any commercially-available PLC may be utilized in light of the teachings herein.

Each motion sensor 120–132 communicates to the PLC CPU 156. To enable the PLC CPU to identify between the various sensors, each sensor is assigned to a specific input port on the PLC CPU. The PLC CPU includes an Uninterrupted Power Supply ("UPS")160 which provides continuous power to the PLC CPU 156 in the event of a power outage. When multiple PLCs 148 are used, perhaps in a networked configuration, a single UPS 160 may suffice. The PLC may include a modem 164 for wireless communication to external devices.

FIG. 4 illustrates a variety of notification options supported by the monitoring system 100 of the present invention. Each option illustrated can be considered to be a continuation of the illustrations in FIGS. 1 and 3 at the point where the "Notification Device" is designated. The notification device 168 chosen depends on the desires of the user or subscriber, the type of PLC 148 selected and the facilities and location of emergency response personnel. For instance, a person living independently at home might choose to have a digital dialer 172 call a friend or family member. This embodiment requires only the Model D2-240 PLC CPU 156, which is less sophisticated and less expensive than the Model D4-440. This may also be the preferred configuration in a small institution such as a residential care facility. In larger facilities, the administrators must support greater numbers of residents through a Local Area Network ("LAN")communicating with a centralized computer 176. In this case, a Model D4-440 PLC CPU may be required. The computer 176 may comprise a commercially-available personal computer.

If the Model D4-440 PLC CPU 156 communicates with the computer via direct cabling, the computer generally must be running a DDE server implemented in a known manner within the computer. Instead, for modem communication between the PLC 148 and computer 176, the Model D4-440 PLC CPU is equipped with an F4-CP128-T modem 164 programmed in BASIC. As such, the computer 176 must have a corresponding modem 180 and associated software. The computer modem 180 may preferably support a data transfer rate of at least 28.8 kbps.

FIG. 4(*a*) illustrates the notification device 168 as comprising a digital dialer 172 that communicates with a standard wired telephone 184 or wireless cell phone 184. FIGS. 4(*b*)–(*c*) illustrate the notification device 168 as comprising a computer 176, including a UPS 188. In FIG. 4(*b*), the computer also connects with a display device 192 (e.g., a video terminal) for display of the notification message communicated from the PLC CPU 156, and a printer 196 for a hard copy printout of the message. In FIG. 4(*c*), the computer 176 connects with a printer 196 and a paging transmitter 200, which pages appropriate personnel, having a corresponding paging receiver 204, with the notification message. The paging transmitter 200 may include its own UPS 208. In FIG. 4(*d*), the notification device 168 comprises a modem 180 integral with the computer 176. The PLC modem 164 may communicate the notification message to the computer modem 180. The computer 176 in FIG. 4(*d*) may communicate with the various output devices illustrated in FIGS. 4(*b*)–(*c*).

The centralized computer 176 runs a Windows-based program (FIG. 6) that manages the modem 180, incoming alarms, alarm notification, and which also supports general system maintenance. This program outputs the alarm in the desired formats to the pager 200, printer 196 and/or display 192. The program also allows the administrator to track component installation dates for battery replacement, resident profile information and event history.

The monitoring system 100 of the present invention supports a variety of embodiments and situations. In one embodiment, the monitoring system is installed in a home, with some or all of its rooms covered by the various sensors of the monitoring system. Typically, this noninstitutional installation uses a centralized computer 176 located in a single room 104 in the home. It also uses the digital dialer 172 for notification, and it only evaluates the sensed data for situations involving alarm conditions and ignores information-only events.

On the other hand, in an installation of the monitoring system 100 in a residential care facility, a single PLC 148 can manage event evaluation for one or more rooms 104, depending on the size and shape of the rooms. The one or more PLCs 148 may communicate with a centralized computer 176 located either on-site or off-site at a remote response center. Off-site communications can also be via a digital dialer 172 to a response center, although this does not provide the rich functionality available through use of the centralized computer 176.

The essential design of the monitoring system 100 of the present invention is the same in all embodiments. Instead, it is the notification methods that vary in the different configurations. In this monitoring system, the infrared sensors 120–132 act as input devices to the PLC CPU 156. Door position sensor(s) 136 are also input to the PLC CPU. The PLC CPU distinguishes its differing inputs based on their connections to the input port. The PLC CPU runs software that essentially contains the intelligence that determines, from the sensor inputs, whether one of its recognizable conditions or "situations" has occurred involving the monitored persons.

The variety of situations recognized by the monitoring system 100 of the present invention encompass both distress/alarm conditions and information-only/non-alarm events. Embodiments employing the digital dialer 172 communicate only distress/alarm conditions and not information-only/non-alarm events. The following is a sampling of various situations supported by the monitoring system of the present invention. Alarm events are denoted with an *, and are communicated in all embodiments of the monitoring system disclosed herein.

Some exemplary situations, involving persons within the monitored area 104, recognized by the monitoring system of the present invention include:

1. Area Occupied—Used as a basis to determine the "Insufficient Activity" situation.

2. *Insufficient Activity—Monitored area is known to be occupied but there has been no movement for a programmed length of time.

3. *Floor Fall—A person is known to have entered the lower zone sensor area 140 and does not appear in the upper zone sensor area 144. This is only an alarm if the person fails to get up within a programmed amount of time.

4. Bathroom Occupied—Used as a basis to determine the "Bathroom Occupied Too Long" situation.

5. *Bathroom Occupied Too Long—Bathroom is known to be occupied and the programmed time parameter has expired.

6. *Sensor Blocked—Something is impairing the sensor's ability to monitor the area and must be moved.

7. Out Of Bed—This may be an alarm condition in the case where the resident is required to stay in bed, or it may be an information-only event.

8. Helper Disable—In the event of any alarm condition, the sensing of another person within the monitored area 104 will trigger the PLC 148 to stop sending an alarm. When used in a computer notification configuration, the alarm continues to display on the screen until the operator enters the information concerning the event.

In a typical room installation illustrated in FIG. 1, the monitoring system 100 comprises a collection of sensors 120–136 communicating with the PLC CPU 156. Each group of sensors is configured to enable the PLC CPU to recognize specific events. Sensor group one 120,124 and sensor group two 128,132 are configured to report information to the PLC CPU 156, from which it can recognize a floor fall. The door sensor data provide the PLC CPU with the information needed to determine area occupancy. A similar door sensor 136 on a bathroom door determines bathroom occupancy. Additional, optional sensors 152, located within the bed 108 and/or chair 112, indicate the presence of a person on the bed and/or chair. These sensors provide an increased level of redundancy and accuracy.

The aforementioned situations are determined by an exemplary embodiment of the monitoring system 100 of the present invention as follows:

1. Area Occupied—Typically, when the PLC CPU 156 receives a message from the door sensor 136, it then waits to see if any of the interior room sensors 120–132 report the presence of a person. For example, if movement is reported, the PLC CPU knows the area is occupied.

2. Insufficient Activity—When the PLC CPU knows the area is occupied, it sets an internal timer based on a programmable parameter. The timer may have different settings for day and night. Any input from a sensor resets the timer. If the timer goes off, the PLC 148 sends an "Insufficient Activity" alarm to the notification device 168. This function may be utilized for a bathroom as well.

3. Floor Fall—Sensor groups one and two 120–132 are each configured to monitor dual zones 140,144. Each sensor group includes a sensor monitoring the lower floor zone 140 and a sensor monitoring the upper zone 144. When the PLC CPU receives an input from the lower zone sensor 124 and no input from the upper zone sensor 120, it sends a "Floor Fall" alarm to the notification device 168.

4. Bathroom Occupied—When the PLC CPU 156 receives a message from the bathroom door sensor 136, it knows the area 104 is occupied. This simplistic implementation will usually be enhanced through the addition of a pair of "Floor Fall" sensors (i.e., upper and lower zone motion sensors 120,124) installed in the bathroom.

5. Bathroom Occupied Too Long—When the PLC CPU 156 knows the bathroom is occupied, it sets a programmable timer. An input from the bathroom door contact 136 resets the timer. If the timer goes off, the PILC CPU send a "Bathroom Occupied Too Long" alarm to the notification device 168.

6. Sensor Blocked—When the PLC CPU knows the area is occupied, each sensor's timer is set to a programmable length of time. If no motion is detected, the PLC CPU sends a "Sensor Blocked" alarm to the notification device. This timer is set based on the time of day, since no motion at night does not necessarily mean a sensor is blocked. However, some modern motion sensors can automatically determine a sensor-blocked condition, from the situation where no activity is detected by the sensor, and communicate such condition directly to the PLC CPU 156.

7. Out Of Bed—The PLC CPU sends an "Out of Bed" alarm to the notification device 168 when motion is detected by any sensor outside of the area of the bed 108. In FIG. 1, this means that when motion is detected in the lower zone 140 of either sensor group, an "Out of Bed" condition is recognized.

8. Helper Disable—If the PLC CPU determines that more than one person is within the monitored area 104, depending on the option selected, it can either not report any alarms, report alarms as information-only, or report alarms for distress situations. The PLC CPU may also turn off alarms when a helper is detected.

The monitoring system 100 also supports different situation configurations for different persons. For example, an out-of-bed situation may be triggered for one person after 15 minutes, but not until 30 minutes have expired for another person. This is easily accomplished by the software programmed into the PLC CPU 156.

As added functionality within the monitoring system of the present invention, the PLC may also perform data logging, independent of the computer 176 comprising the notification device 168. Also, the PLC can send its output to a security service or an energy management system. Other user-generated inputs, such as a user-activated emergency call button, may also be supported by the PLC.

As depicted in FIG. 3, each sensor 120–136 connects to the PLC CPU 156 via a predetermined input port. The PLC CPU sets/resets timers, sets/resets state characteristics, and outputs appropriate messages, depending on the chosen installation configuration of the PLC.

Figure 5:
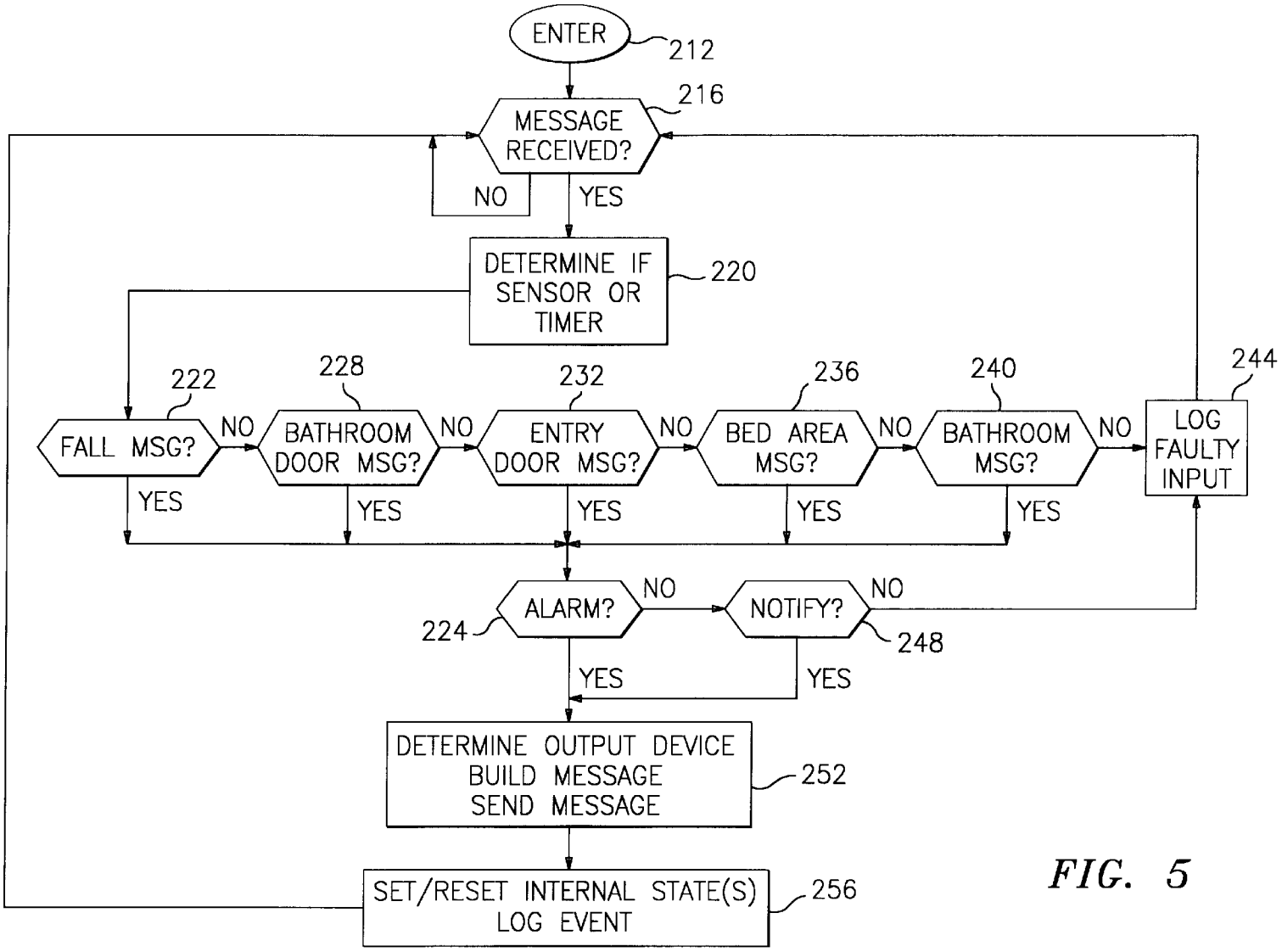
FIG. 5 is a flowchart illustrating the operation of the PLC component of the monitoring system of FIG. 1.

The flowchart of FIG. 5 illustrates the operation of the software-programmable PLC CPU 156 and sensor arrangement of FIG. 3 during the monitoring of persons in various rooms 104 of a home or institution. After an enter step 212, the PLC CPU 156 checks, in a step 216, if it has received any messages from the sensors or programmable timers. If so, the PLC CPU determines, in a step 220, whether the message came either from the sensors or timers. If no messages have been received, the PLC CPU continues to wait in the step 216 until it receives a message.

Having received a message and determined its source (sensor or timer), the PLC CPU checks, in a step 222, whether the received message is a person fallen message. If so, the PLC CPU branches to a step 224 where it checks whether the fall message is an alarm. If the message is not a fall message, the PLC CPU checks, in a step 228, whether the message is a bathroom door message. If so, the PLC CPU branches to the step 224 where it checks whether the bathroom door message is an alarm. If the received message is not a bathroom door message, the PLC CPU, in a similar manner, checks, in various steps 232–240, whether the message is either an entry door message, a bed area message or a bathroom message. (Other types of messages are contemplated by the monitoring system 100 of the present invention; for example, messages associated with an appliance on or a water running situation.) If the message is not any of these, the PLC CPU logs a faulty input in a step 244, and returns to the check for message received step 216.

In contrast, if the PLC CPU 156 determines the existence of any one of these messages, the PLC CPU will always branch to the step 224 where it checks if the message is an alarm message. If the received message is not an alarm message, the PLC CPU checks, in a step 248, whether the message is an information-only notification. If not, the PLC CPU branches to the step 244 where it logs a faulty input.

On the other hand, if the PLC CPU determines the received message is either an alarm message or an information-only message, the PLC CPU determines, in a step 252, the output notification device and then builds and sends the appropriate message packet to the connected notification device, depending upon certain conditions.

For example, if an alarm condition exists, or a message condition exists and the notification device 168 is not a digital dialer 172, the PLC CPU 156 builds the message packet. If the notification device is a digital dialer, the PLC CPU outputs the dry contact closure which triggers the dialer. If the notification device is a computer 176, the PLC CPU builds the appropriate message packet and passes it either to the DDE server or to the modem 164 for transmission to the computer.

Next, the PLC CPU sets/resets any necessary state indicators and logs or stores the event, in a step 256, in memory associated with the computer. The PLC CPU then branches back to the step 216 where it waits for messages from the sensors 120–136 and timers. Depending on the type of PLC CPU utilized, up to 64 input devices can be supported by the monitoring system 100 of the present invention. This is a sufficient number of inputs to adequately monitor a standard size room 104 having a bath, depending on the functionality to be supported.

As depicted in FIGS. 4(*a*)–(*d*), a variety of notification devices 168 are supported by the monitoring system 100 of the present invention. When coupled to a digital dialer 172 (FIG. 4(*a*)), the PLC CPU 156 supports a local output in the form of a dry contact closure or other output suitable to drive the dialer. The dialer 172 can be any of a variety of commercially-available devices, depending on the message desired to be transmitted over the phone 184. Once the dialer is triggered, it uses the phone lines to connect with a designated phone number. The dialer then plays a pre-recorded message indicating that a person is in distress at the location of the monitored area. The receiver of the message can be a family member, a security service, or any support service of the subscriber's choice.

On the other hand, when coupled to a computer 176, the PLC CPU 156 supports a variety of outputs, as well as logging and database maintenance. In operation, a PLC CPU activated by a situation will transmit a message containing location and situation information over a LAN (FIGS. 4(*b*)–(*c*)), or via a modem 180 (FIG. 4(*d*)). The computer 176 is typically located at a designated response center within an institution, or off-site at a security service center. Upon receiving the information from the PLC 148, the response center computer may display the alarm on the screen 192, as well as transmit the alarm to any additional output devices such as a printer 196 and/or a paging device 200.

The computer 176 continues to display the alarm (and send the paging message, if desired) until it is silenced by response personnel. To silence the alarm, the operator must enter identifying information and data regarding the resolution of the situation. If the pager was used, the person who responded to the alarm must call in the appropriate information and the center personnel will enter the information. Alternatively, if the "Helper Disable" function is chosen, the presence of the responder will send a silence message to the computer. In this case, only the time of the response will be captured. If desired, all messages from the PLC CPU may be sent to the printer 196, as well as stored in the internal database or memory of the computer 176.

The computer includes appropriate software for monitoring system operations and control as well as for providing a database of resident information. The resident information typically encompasses descriptive data such as age, height, weight, location, health conditions and an optional photograph. Data on the system components may also be maintained on the computer 176. This information describes the location, serial number and installation date of each sensor 120–136 and PLC CPU 156. Historical data on recorded events are also kept in the computer for purposes of administrative review. These are displayed in a variety of sort orders to both the screen and a printer.

Figure 6:
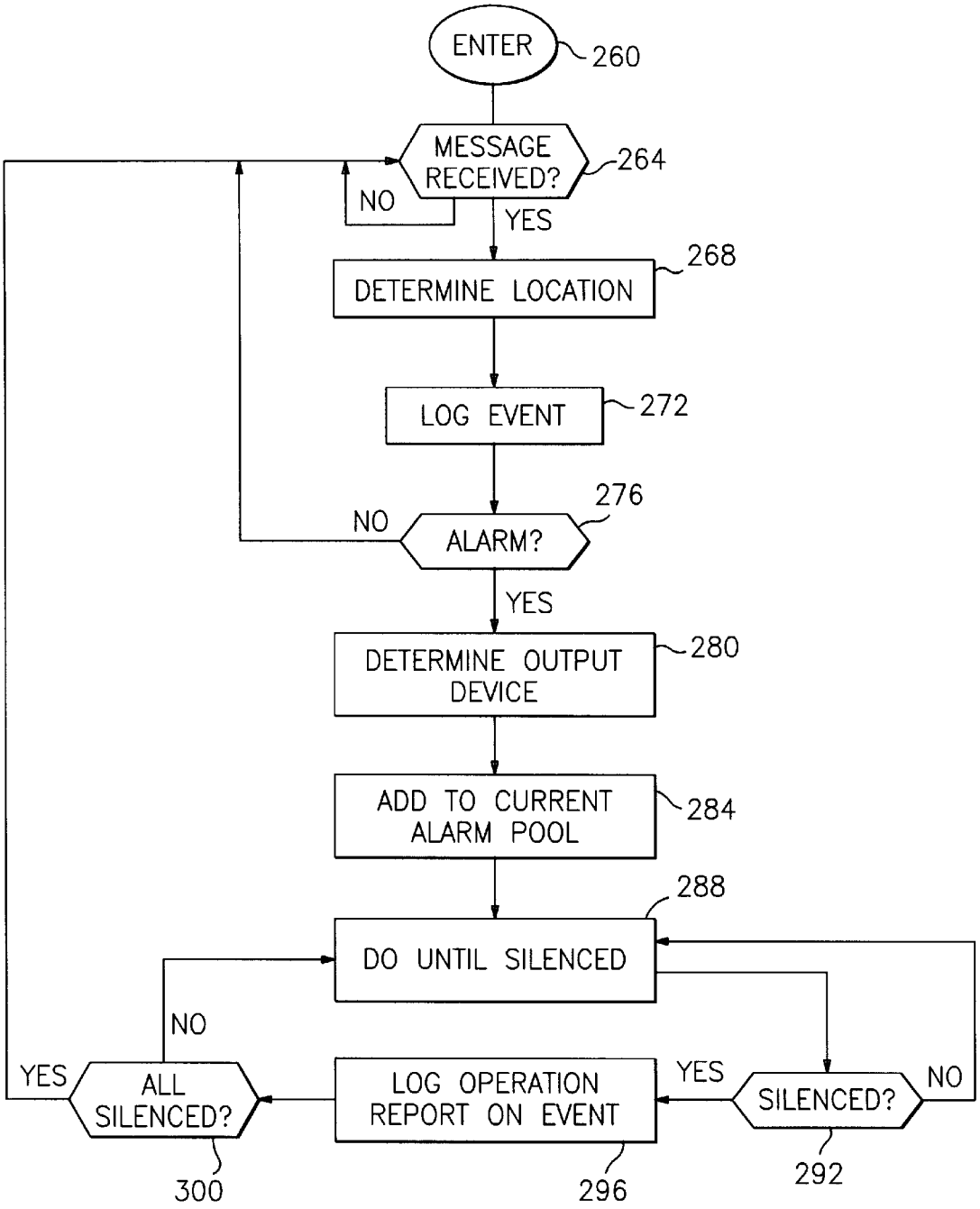
FIG. 6 is a flowchart illustrating the operation of the computer notification device of FIG. 4 within the monitoring system of FIG. 1.

The flowchart of FIG. 6 illustrates an example of the operation of the computer 176 comprising the notification device 168 of FIG. 4. After an enter step 260, the computer waits, in a step 264, to receive a message either from a modem 164,180 or a DDE server. When a message arrives, it is parsed, in a step 268, to extract all of its information, including situation type, time and location. The message is then logged in a step 272.

Next, the message is checked, in a step 276, to see if it is an alarm message. If it is not an alarm, the computer branches back to the wait for message step 264. Otherwise, the computer determines, in a step 280, which output device(s) 192–200, connected to the computer, are to be activated. The computer then adds, in a step 284, the new alarm to the alarm pool, which is a list of active alarm conditions.

The computer software then performs a step 288 where the computer displays/redisplays and/or sends/resends the alarm for which an alarm timer has gone off. It also checks for the arrival of any new alarms. The computer then checks, in a step 292, if an alarm has been silenced. If not, the computer branches back to the step 288. If an alarm has been silenced, the operator information is captured, in a step 296, in the database if the silence was entered at the terminal. If a "Helper Disable" message silences the alarm, the time of the arrival of the helper is also captured and the alarm is removed from the alarm pool, all in the step 296. The software then checks, in a step 300, if all alarms have been silenced. If not, the software branches back to the step 288. If all alarms have been silenced, the computer returns to its initial wait for message step 264.

During the execution of the software routine of FIG. 6, if an operator is performing maintenance or reviewing history, the occurrence of an alarm will take precedence over the maintenance display.

The present invention is illustrative of a novel method of providing monitoring of living areas for the purpose of responding to critical situations in multi-residence facilities or individual domiciles. What has been described and illustrated herein are exemplary embodiments of sensors, signal processors, notification devices and display devices, along with examples of a number of exemplary situations involving monitored persons.

For example, the monitoring system 100 has been described and illustrated herein as comprising pairs of vertically spaced motion sensors 120–132. However, it is to be understood that this description is purely exemplary of one embodiment of the present invention. Other types and arrangements of sensors may be utilized for sensing the presence of a person within a predetermined area. Also, the methods of information communication between various components of the monitoring system and described herein are purely exemplary. Further, the various types of notification devices 168 described herein are also strictly exemplary.

Everything detailed in this document should be considered strictly as a model for purposes of education. It should be recognized that the critical point of the monitoring system of the present invention is its ability to translate human motion and/or lack of motion, as determined by area-based sensors, into a recognized situation requiring notification to a device accessible to response personnel.

It should be understood by those skilled in the art that obvious structural modifications can be made, in light of the teachings herein, without departing from the scope of the invention. Accordingly, reference should be made primarily to the accompanying claims, rather than the foregoing specification, to determine the scope of the invention.

Having thus described the invention, what is claimed is:

1. A situation-based monitoring system comprising:

fall sensor means for sensing a fall by a person within a predetermined area and for providing at least two sensed signals containing information indicative of the fall, wherein the sensor means comprises:

(i) motion sensing means for sensing any motion of the person within the predetermined area, wherein the motion sensing means comprises a pair of motion sensors arranged within the predetermined area;

(ii) wherein a first one of the motion sensors in the pair is disposed to sense motion of the person within the predetermined area within a first portion of the predetermined area extending from a first predetermined height to a second predetermined height and is disposed to provide a first motion signal indicative of the presence or absence of the person within the first portion of the predetermined area; and (iii) wherein a second one of the motion sensors in the pair is disposed to sense motion of the person within a second portion of the predetermined area extending from a third predetermined height to a fourth predetermined height and is disposed to provide a second motion signal indicative of the presence or absence of the person within the second portion of the predetermined area;

signal processing means, responsive to both the first and second motion signals for determining the condition of distress of the person falling down within the predetermined area from, at least in part, a condition where the first motion signal is indicative of the presence of the person within the first portion of the predetermined area and where the second motion signal is indicative of the absence of the person within the second portion of the predetermined area, and for providing at least one condition signal indicative of the existence of the condition of distress as determined by the signal processing means;

notification device means, responsive to the at least one condition signal, for providing an output signal indicative of the existence of the condition of distress associated with the person within the predetermined area; and output device means, responsive to the output signal, for providing a recognizable indication of the condition of distress associated with the person within the predetermined area.

2. The situation-based monitoring system of claim 1, further comprising door position sensing means for sensing a position of a door within the predetermined area and for providing a door position signal indicative thereof, and wherein the signal processing means is responsive to the door position signal for determining the condition of distress of the person within the predetermined area from a condition where the door position signal is indicative of the presence of the person within the predetermined area for a period of time that exceeds a predetermined period of time.

3. The situation-based monitoring system of claim 1, further comprising door position sensing means for sensing a position of a door within the predetermined area and for providing a door position signal indicative thereof, and wherein the signal processing means is responsive to the door position signal for determining a condition where the person is within the predetermined area for a period of time.

4. The situation-based monitoring system of claim 1, further comprising motion sensing means for sensing any motion of the person within the predetermined area and for providing a motion signal indicative thereof, and wherein the signal processing means is responsive to the motion signal for determining a condition where the person is within the predetermined area for a period of time.

5. The situation-based monitoring system of claim 1, wherein the notification device means comprises a telephone dialing means, responsive to the at least one condition signal indicative of the existence of the condition of distress of the person within the predetermined area, for communicating the output signal indicative of the condition of distress to the output device means, wherein the output device means comprises a telephone.

6. The situation-based monitoring system of claim 1, wherein the notification device means comprises a computer, responsive to the at least one condition signal indicative of the existence of the condition of distress of the person within the predetermined area, for communicating the output signal indicative of the condition of distress to the output device means, wherein the output device means comprises a display device means for providing a recognizable display of the condition of distress.

7. The situation-based monitoring system of claim 6, wherein the display device means comprises means for providing a visual display of the condition of distress.

8. The situation-based monitoring system of claim 6, wherein the display device means comprises means for providing an audio display of the condition of distress.

9. The situation-based monitoring system of claim 6, wherein the display device means comprises means for paging a remote paging receiver, the means for paging comprising means for transmitting an informational signal indicative of the condition of distress to the remote paging receiver.

10. The situation-based monitoring system of claim 1, wherein the signal processing means includes first modem means and wherein the notification device means includes second modem means, and wherein the first modem means comprises means for transmitting the at least one condition signal to the second modem means.

11. The situation-based monitoring system of claim 1, wherein the at least one condition signal indicative of the existence of the condition of distress contains information regarding a type of distress condition of the person within the predetermined area.

12. The situation-based monitoring system of claim 11, wherein the type of distress condition of the person within the predetermined area is selected from the group consisting of the person is within the predetermined area but has not moved for a length of time that exceeds a first predetermined length of time, the person is within the predetermined area for a length of time that exceeds a second predetermined length of time, and the person is away from a designated location within the predetermined area for a length of a time that exceeds a third predetermined length of time.

13. The situation-based monitoring system of claim 1, wherein the at least one condition signal indicative of the existence of the condition of distress of the person within the predetermined area is an alarm signal, and wherein the notification device means comprises means, responsive to the alarm signal, for providing the output signal to the output device means, the output device means comprising means for providing a recognizable indication of the alarm signal.

14. The situation-based monitoring system of claim 1, wherein the at least one condition signal indicative of the existence of the condition of distress of the person within the predetermined area is an information-only signal, and wherein the notification device means comprises means, responsive to the information-only signal, for providing the output signal to the output device means, the output device means comprising means for providing a recognizable indication of the information-only signal.

15. The situation-based monitoring system of claim 1, wherein the at least one condition signal indicative of the existence of the condition of distress contains information regarding a time of occurrence of the distress condition and a location of the distress condition associated with the person within the predetermined area.

16. The situation-based monitoring system of claim 1, wherein the signal processing means is located within the predetermined area, and wherein the notification device means is located outside of the predetermined area.

17. A situation-based monitoring system comprising:

fall sensor means for sensing a fall by a person within a predetermined area and for providing at least one sensed signal containing information indicative of the fall wherein the sensor means comprises:

(i) motion sensing means for sensing any motion of the person within the predetermined area, wherein the motion sensing means comprises at least a pair of motion sensors respectively arranged within upper and lower zones of the predetermined area such that a first one of the motion sensors in the pair is disposed to sense motion of the person within the lower zone and to provide a first motion signal indicative of the presence of the person within the lower zone, and wherein a second one of the motion sensors in the pair is disposed to sense motion of the person within the upper zone and to provide a second motion signal indicative of the presence or absence of the person within the upper zone;

(ii) wherein the lower zone extends from a first predetermined height to a second predetermined height within the predetermined area;

(iii) wherein the first one of the motion sensors in the pair is disposed to sense motion of the person within the lower zone and to provide the first motion signal indicative of the presence of the person within the lower zone;

(iv) wherein the upper zone extends from a third predetermined height to a fourth predetermined height within the predetermined area; and (v) wherein the second one of the motion sensors in the pair is disposed within the upper zone to provide the second motion signal indicative of the presence or absence of the person within the upper zone;

signal processing means, responsive to the first and second motion signals, for determining the condition of distress of the person falling down within the predetermined area, at least in part, from a condition where the first motion signal is indicative of the presence of the person within the first portion of the predetermined area and where the second motion signal is indicative of the absence of the person within the second portion of the predetermined area, and for providing at least one condition signal indicative of the existence of the condition of distress as determined by the signal processing means;

notification device means, responsive to the at least one condition signal, for providing an output signal indicative of the existence of the condition of distress associated with the person within the predetermined area; and output device means, responsive to the output signal, for providing a recognizable indication of the condition of distress associated with the person within the predetermined area.

* * * * *